US011313298B2

(12) United States Patent
Denert et al.

(10) Patent No.: US 11,313,298 B2
(45) Date of Patent: Apr. 26, 2022

(54) REVERSE-ROTATION ROBUST SYNCHRONIZATION METHOD

(71) Applicant: VITESCO TECHNOLOGIES GMBH, Hannover (DE)

(72) Inventors: Camille Denert, Toulouse (FR); Benjamin Marconato, Toulouse (FR); Nora-Marie Gouzenes, Toulouse (FR)

(73) Assignee: VITESCO TECHNOLOGIES GMBH, Hanover (DE)

( * ) Notice: Subject to any disclaimer, the term of this patent is extended or adjusted under 35 U.S.C. 154(b) by 0 days.

(21) Appl. No.: 17/280,776

(22) PCT Filed: Sep. 27, 2019

(86) PCT No.: PCT/EP2019/076203
§ 371 (c)(1),
(2) Date: Mar. 26, 2021

(87) PCT Pub. No.: WO2020/065020
PCT Pub. Date: Apr. 2, 2020

(65) Prior Publication Data

US 2022/0042469 A1 Feb. 10, 2022

(30) Foreign Application Priority Data

Sep. 27, 2018 (FR) ..... 1858888

(51) Int. Cl.
*F02D 41/00* (2006.01)
*F02D 41/22* (2006.01)

(52) U.S. Cl.
CPC ..... *F02D 41/009* (2013.01); *F02D 41/22* (2013.01); *F02D 2041/0095* (2013.01); *F02D 2200/101* (2013.01); *F02D 2250/06* (2013.01)

(58) Field of Classification Search
CPC ..... F02D 41/009; F02D 41/22; F02D 2041/0095; F02D 2200/101; F02D 2250/06
See application file for complete search history.

(56) References Cited

U.S. PATENT DOCUMENTS

| | | | | |
|---|---|---|---|---|
| 11,131,567 | B2 * | 9/2021 | Weber | G01D 5/24461 |
| 11,199,426 | B2 * | 12/2021 | Weber | G01D 5/249 |
| 2003/0000293 | A1 * | 1/2003 | Robertson | G01M 15/06 73/114.06 |

(Continued)

FOREIGN PATENT DOCUMENTS

| | | |
|---|---|---|
| DE | 10 2013 217 031 | 3/2014 |
| EP | 1 878 897 | 1/2008 |

OTHER PUBLICATIONS

International Search Report for PCT/EP2019/076203 dated Sep. 27, 2019, 5 pages.

(Continued)

*Primary Examiner* — George C Jin
(74) *Attorney, Agent, or Firm* — Nixon & Vanderhye

(57) ABSTRACT

Disclosed is a method for synchronizing an internal combustion engine including at least one camshaft, on which a target is mounted, a position sensor for sensing the position of the camshaft and a processing unit, the method transmitting a synchronization or synchronization fault signal as a function of the determined direction of rotation of the target.

20 Claims, 7 Drawing Sheets

(56) References Cited

U.S. PATENT DOCUMENTS

| | | | | |
|---|---|---|---|---|
| 2004/0153235 | A1* | 8/2004 | Kataoka | B60W 10/08 701/112 |
| 2009/0030587 | A1* | 1/2009 | Yonezawa | F02D 41/28 701/103 |
| 2013/0151194 | A1 | 6/2013 | Hawken et al. | |
| 2013/0238224 | A1 | 9/2013 | Fujiwara et al. | |
| 2018/0298836 | A1* | 10/2018 | Stowasser | F01L 1/344 |
| 2020/0284692 | A1* | 9/2020 | Kwon | F02D 43/00 |

OTHER PUBLICATIONS

Written Opinion of the ISA for PCT/EP2019/076203 dated Sep. 27, 2019, 8 pages.

* cited by examiner

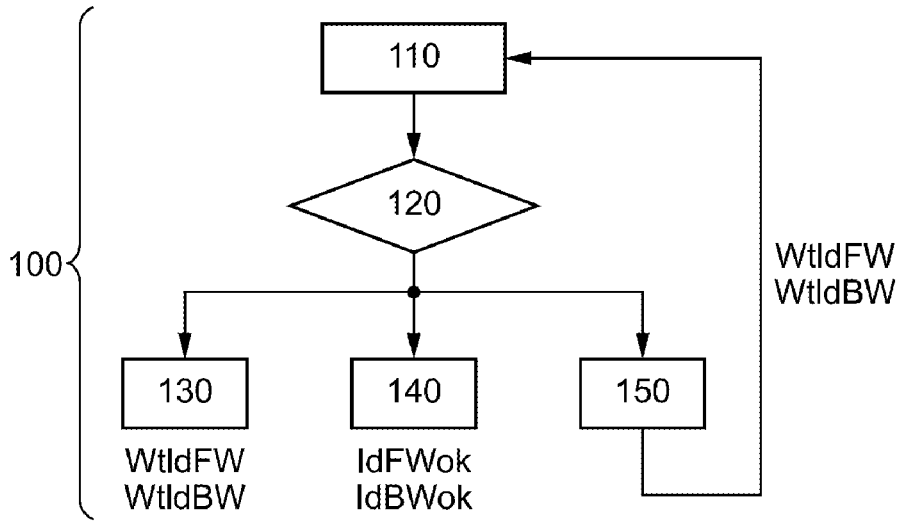
FIG. 4a
FIG. 4b
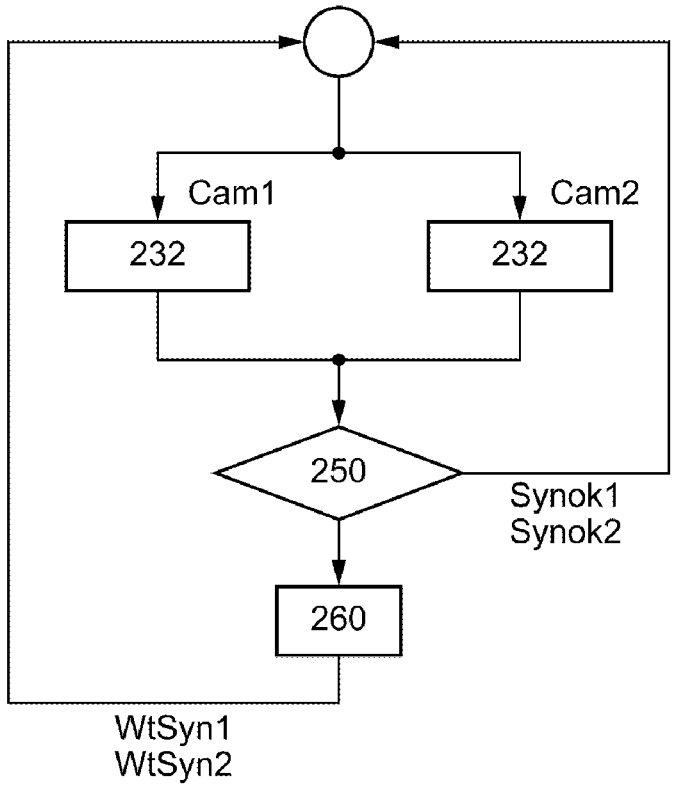

REVERSE-ROTATION ROBUST SYNCHRONIZATION METHOD

CROSS-REFERENCE TO RELATED APPLICATIONS

This application is the U.S. national phase of International Application No. PCT/EP2019/076203 filed Sep. 27, 2019 which designated the U.S. and claims priority to FR 1858888 filed Sep. 27, 2018, the entire contents of each of which are hereby incorporated by reference.

FIELD OF THE INVENTION

The invention relates to a method for synchronizing an internal combustion engine based on the detection of the rising or falling edges of the teeth of a camshaft target, in order to determine the position of the engine.

The invention is particularly adapted to the implementation of a synchronization method that is effective against the reverse rotation phases of the engine.

PRIOR ART

In order to determine the position of an internal combustion engine within the engine cycle, determining both the position of the engine crankshaft and of an engine camshaft is known.

To this end, at least two targets in the form of toothed wheels are securely mounted, respectively on the crankshaft and on a camshaft, and a respective sensor detects the edges of the teeth, respectively of each target, during the rotation of the crankshaft and of the camshaft. The detected data are subsequently processed in order to deduce the position of the engine.

With respect to the camshaft, it is the subject of a specific synchronization method that aims to identify each edge of the target detected by the sensor in order to deduce information therefrom that relates to the speed (engine speed in revolutions per minute) and the position of the engine, which information subsequently can be compared with the data relating to the position of the crankshaft in order to complete and/or correct said data.

This synchronization method is only performed by taking into account the information detected from the position of the camshaft target, i.e. without the data relating to the crankshaft, to allow the engine to operate in degraded mode if the crankshaft is faulty.

A conventionally implemented synchronization method involves determining, for each tooth edge of the target of the camshaft detected by the sensor, a time signature of this tooth edge, and comparing this signature with precomputed theoretical signatures of each edge of the target, through the consideration of a tolerance with respect to the value of the theoretical signature.

If the comparison does not result in any correspondence, the synchronization is not performed.

If the comparison results in a single correspondence, the synchronization is performed and the detected edge is identified as being that for which the theoretical signature corresponds to the time signature of the detected edge.

Finally, if the comparison results in several correspondences, the method is repeated for the following edge in order to refine the correspondence.

However, this type of synchronization method, which is known from document US 2013/151194 is not effective against all the situations experienced by the engines.

A first example is that of a reverse rotation of the engine, which occurs, for example, when the vehicle reverses with a gear engaged (for example, on a slope).

In this case, the signal measured by the sensor of the camshaft target can resemble a signal that would be measured if the vehicle advanced, and it can result in an erroneous identification of an edge of the camshaft target.

This is the case, for example, in FIG. 1*a*, which at the top shows a curve of the engine speed as a function of time (which is negative in this case) and at the bottom shows the progress of the edges of the camshaft target in front of the sensor, with the crosses corresponding to edges identified during the implementation of the synchronization algorithm. The synchronization algorithm is configured to only detect a forward progression. However, in a first zone A1, about twenty consecutive false detections have been observed during the reverse rotation, and, in a second zone A2, about twenty other consecutive false detections have been observed, each time corresponding to a forward rotation, whereas in reality the engine is in reverse rotation.

In other words, in these zones a progression of the camshaft as a forward rotation is detected in error.

In this case, the information provided by the synchronization algorithm does not match the data originating from the analysis of the position of the crankshaft target, which can generate a fault in the engine computer or the undue detection of a fault in determining the position of the crankshaft.

In a case whereby the analysis of the position of the crankshaft also would be erroneous, the engine would operate in degraded mode only based on the signals of the camshaft. In this case, if a rotation is detected in error, an injection of fuel can be authorized and can damage the engine.

Another example is that of engine stalling, i.e. a phase close to engine shutdown where the engine performs multiple bounce-backs in one direction then the other before stopping.

The successive bounce-backs in this case can lead to, via the synchronization algorithm, the detection of edges very close to the camshaft target, and can provide erroneous information of very high engine speed if the bounce-backs are not detected. The speed determined by the synchronization algorithm is then significantly different from the engine speed, which can be detected as compromising the safety of the vehicle and of its driver. The computer that computes the engine speed then can be considered to be defective, which generates a breakdown involving the replacement of the engine computer.

FIG. 1*b* shows a case of engine speed bounce-back accompanied by false detections of the position of the crankshaft. The top of FIG. 1*b* shows the engine speed, which, as can be seen, is alternatively negative and positive due to the bounce-back.

The bottom of FIG. 1*b* shows a zone of four false detections of edges of the camshaft target. These detections occur while the engine is in a reverse rotation phase associated with the bounce-back. Once again, this false detection can generate a breakdown of the engine computer.

DISCLOSURE OF THE INVENTION

In view of the above, the aim of the invention is to at least partly overcome the disadvantages of the prior art. In particular, an aim of the invention is to propose a synchronization method that is effective against a case of reverse rotation of the engine.

To this end, the aim of the invention is a method for synchronizing an internal combustion engine comprising:

at least one camshaft, on which a target is mounted in the form of a toothed wheel, each tooth comprising a rising edge and a falling edge, the wheel having rotational asymmetry;

a position sensor for sensing the position of the camshaft, adapted to detect each rising or falling edge of a tooth of the target; and a unit for processing data generated by the sensor, comprising a memory, in which, for each edge of each tooth of the target, a theoretical signature of the edge is stored considering a forward rotation of the target, and a theoretical signature of the edge is stored considering a reverse rotation of the target, each theoretical signature being associated with a range of tolerance values;

the synchronization method being implemented by the processing unit and comprising the implementation of the following steps:

for each detected tooth edge:

implementing a method for identifying the detected edge considering a forward rotation of the target;

implementing a method for identifying the detected edge considering a reverse rotation of the target;

the implementation of a method for identifying an edge detected for a direction of rotation comprising:

computing a time signature of the detected edge; and comparing the time signature of the detected edge with the ranges of tolerance values of a set of theoretical signatures of edges of the target of the same rising or falling type as the detected edge, corresponding to the direction of rotation of the target;

determining a direction of rotation of the target; and transmitting a synchronization or synchronization fault signal as a function of the direction of rotation of the determined target.

In one embodiment, if the detected edge is determined to be corresponding to an edge of the target in forward rotation, and to be corresponding to an edge of the target in reverse rotation, and if the time signature of the detected edge is within the range of tolerance values of a theoretical signature of a single edge, the detected edge is identified as the edge corresponding to the theoretical signature, and if the time signature of the detected edge is within the range of tolerance values of a theoretical signature of more than one candidate edge, the steps of computing a time signature and of comparing it with the following edge are repeated, the comparison only being implemented with the theoretical signatures of the edges following the candidate edges.

The time signature of a detected edge can be defined, for each edge detected from the third, by:

$$\tau_R(n) = \frac{T_n}{T_{n-1}}$$

where n is the index of a detected edge and $T_n$ is the duration between the index edge n−1 and the index edge n; and the theoretical signature of an edge with which the time signature of a detected edge is compared is defined by:

$$\tau_{th}(n) = \frac{\alpha_n}{\alpha_{n-1}}.$$

As an alternative embodiment, the time signature of a detected edge can be defined, for each edge detected from the fifth, by:

$$\tau_R(n) = \frac{T_n + T_{n-3}}{T_{n-1} + T_{n-2}}$$

where n is the index of a detected edge and $T_n$ is the duration between the index edge n−1 and the index edge n; and the theoretical signature of an edge with which the time signature of a detected edge is compared is defined by:

$$\tau_{th}(n) = \frac{\alpha_n + \alpha_{n-3}}{\alpha_{n-1} + \alpha_{n-2}}$$

where $\alpha_n$ is the angle between the index edge n and the preceding edge, which depends on the direction of rotation of the target.

Advantageously, but optionally, the range of tolerance values associated with each theoretical signature of the set of theoretical signatures of the edges of the target is reduced when the engine speed drops below a predetermined threshold.

In one embodiment, the method comprises, if, during the implementation of the method for identifying the detected edge considering a forward rotation of the target, no correspondence is detected, transmitting a synchronization fault signal.

In one embodiment, the method comprises, if the detected edge is determined to be corresponding to an edge of the target considering a forward rotation, and does not correspond to any edge of the target considering a reverse rotation, transmitting a synchronization signal.

In one embodiment, the assessment of a direction of rotation of the target is implemented by a comparison between:

a first logarithm of the ratio between the time signature of the detected edge and the theoretical signature of the corresponding edge for the forward direction of rotation of the target; and a second logarithm of the ratio between the time signature of the detected edge and the theoretical signature of the corresponding edge for the rearward direction of rotation of the target.

Advantageously, but optionally, the direction of rotation is determined as being the rearward direction of rotation if a difference between the first and the second logarithm is greater than a predetermined margin value.

In one embodiment, the method comprises:

transmitting a synchronization signal if the direction of rotation of the target is a forward rotation; and transmitting a synchronization fault signal if the direction of rotation of the target is a reverse rotation.

Alternatively, the transmission of a synchronization or a synchronization fault signal is also performed as a function of a preceding synchronization or synchronization fault signal transmitted by the processing unit.

For example, the processing unit can be adapted to generate an external synchronization variable that can assume a first value forming the synchronization signal, and a second value forming the synchronization fault signal, and wherein, if the external synchronization variable assumes the first value when the direction of rotation of the target is determined as being rearward, a counter is decremented and the external synchronization variable only assumes the second value if the counter reaches a zero value.

In another embodiment, in the event of a loss of synchronization, the processing unit is adapted to only transmit the next synchronization signal in the event of the detection of a predetermined number of successive edges considered to be corresponding to a forward rotation of the target.

In one embodiment, the synchronization method is implemented by an engine comprising:

- an intake camshaft and an exhaust camshaft, with a target being respectively mounted on each shaft, at least one of which has rotational asymmetry; and
- two position sensors respectively for sensing the position of each camshaft; and
- two processing units, each processing unit being adapted to process the data generated by a respective position sensor, the processing units being adapted to generate an external synchronization variable that can assume a first value indicating a synchronization and a second value indicating a synchronization fault;

wherein, if a processing unit corresponding to an asymmetrical target generates a synchronization fault signal on completion of a step of determining a direction of rotation of the camshaft, the other processing unit is configured to generate a synchronization fault signal for the camshaft with which it corresponds.

A further aim of the invention is a computer program product, comprising code instructions for implementing the synchronization method according to the previous description, when it is implemented by a computer adapted to implement the method.

The invention also relates to an internal combustion engine comprising:

- at least one camshaft, on which a target is mounted in the form of a wheel comprising a plurality of teeth distributed over its circumference, each tooth comprising a rising edge and a falling edge, the wheel having rotational asymmetry;
- a position sensor for sensing the position of the camshaft, adapted to detect each rising or falling edge of a tooth of the target; and
- a processing unit receiving signals for detecting the edge of the sensor, and configured to implement the synchronization method according to the previous description.

The proposed synchronization method is effective against a reverse rotation of the engine since it allows such a reverse rotation to be detected by implementing an identification of the detected edge, while considering both a forward rotation and a reverse rotation of the wheel. If a detected edge corresponds to an edge in the two possible directions of rotation of the wheel, the direction of rotation is determined at the following edge.

If the direction of rotation is a reverse rotation, the synchronization is prevented even if a correspondence has also been detected for an edge corresponding to a forward rotation.

In the event that the engine comprises two camshafts, the invention also allows the synchronization of the two camshafts to be prevented if a reverse rotation is detected for one of the two camshafts.

BRIEF DESCRIPTION OF THE DRAWINGS

Further features, aims and advantages of the invention will become apparent from the following description, which is purely illustrative and non-limiting, and which must be read with reference to the appended figures, in which:

FIG. 4*a* schematically shows the implementation of an edge identification method;

FIG. 4*b* schematically shows the implementation of a synchronization method in an engine comprising two camshafts.

DETAILED DESCRIPTION OF EMBODIMENTS OF THE INVENTION

Internal Combustion Engine

Figure 1A:
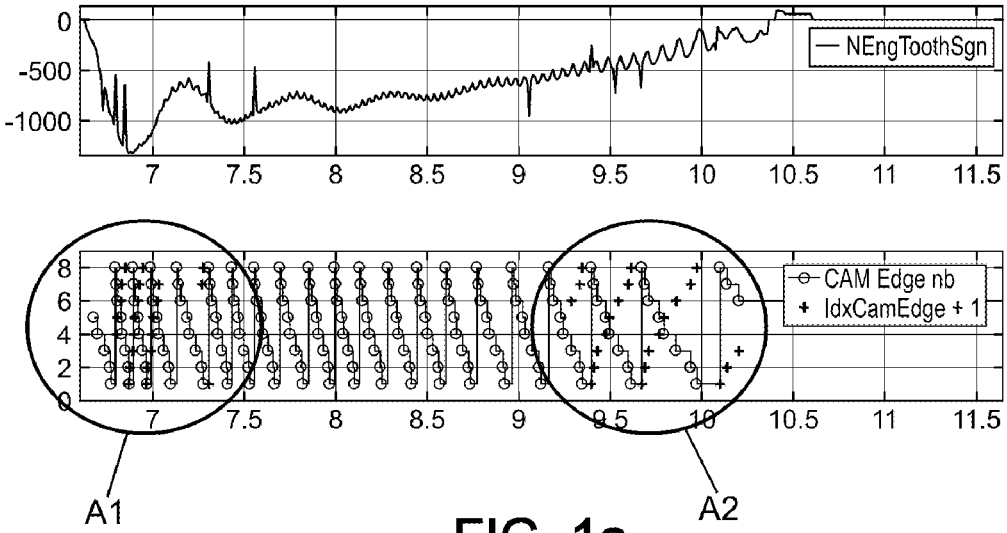
FIG. 1*a*, already described, shows a case of an error of a synchronization algorithm of the prior art in the event of reverse rotation of the engine.
Figure 1B:
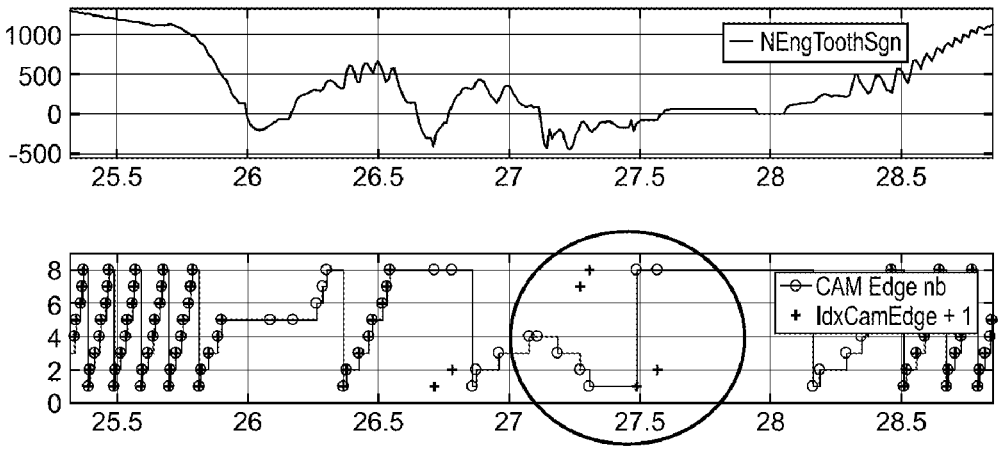
FIG. 1*b*, also already described, shows a case of an error of a synchronization algorithm of the prior art in the event of engine stalling.
Figure 2A:
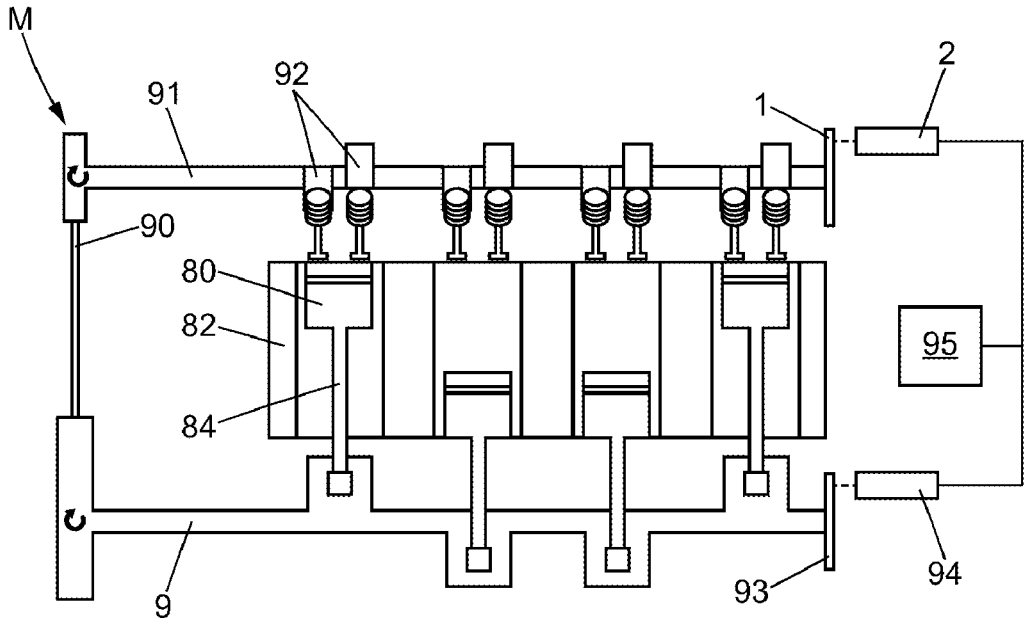
FIG. 2*a* schematically shows an example of an internal combustion engine, in which the synchronization algorithm can be implemented.

FIG. 2*a* schematically shows an internal combustion engine M comprising a set of movable pistons 80 moving in respective cylinders 82 between a top dead centre and a bottom dead centre, the engine M also comprising a crankshaft 9 driven by the movement of the pistons in the cylinders by means of respective connecting rods 84.

The crankshaft rotates, by means of a timing belt 90, at least one camshaft 91, the rotation of which successively causes the intake and exhaust valves 92 to open and close.

In one embodiment (not shown), the engine M can comprise two camshafts 91 comprising a camshaft, called intake camshaft, the rotation of which allows the intake valves to be opened and closed, and a camshaft, called exhaust camshaft, the rotation of which allows the exhaust valves to be opened and closed.

The crankshaft 9 comprises a toothed wheel 93 comprising a set of teeth evenly distributed over its circumference. A crankshaft angular position sensor 94 is positioned facing the toothed wheel 93 and is adapted to detect the passage of each tooth of the wheel and to deduce an angular position of the crankshaft therefrom.

Figure 2B:
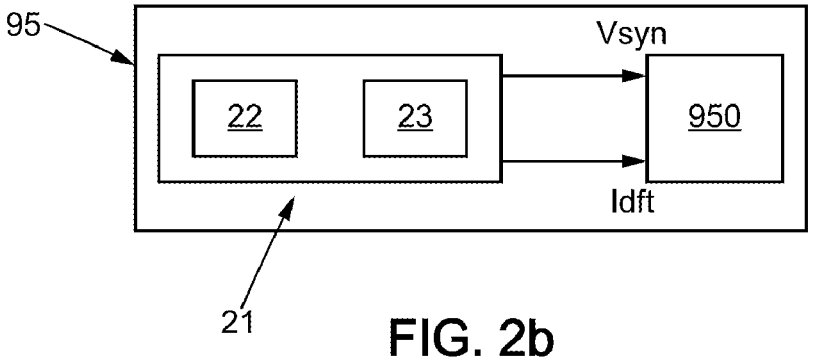
FIG. 2*b* schematically shows an engine computer.
Figure 2C:
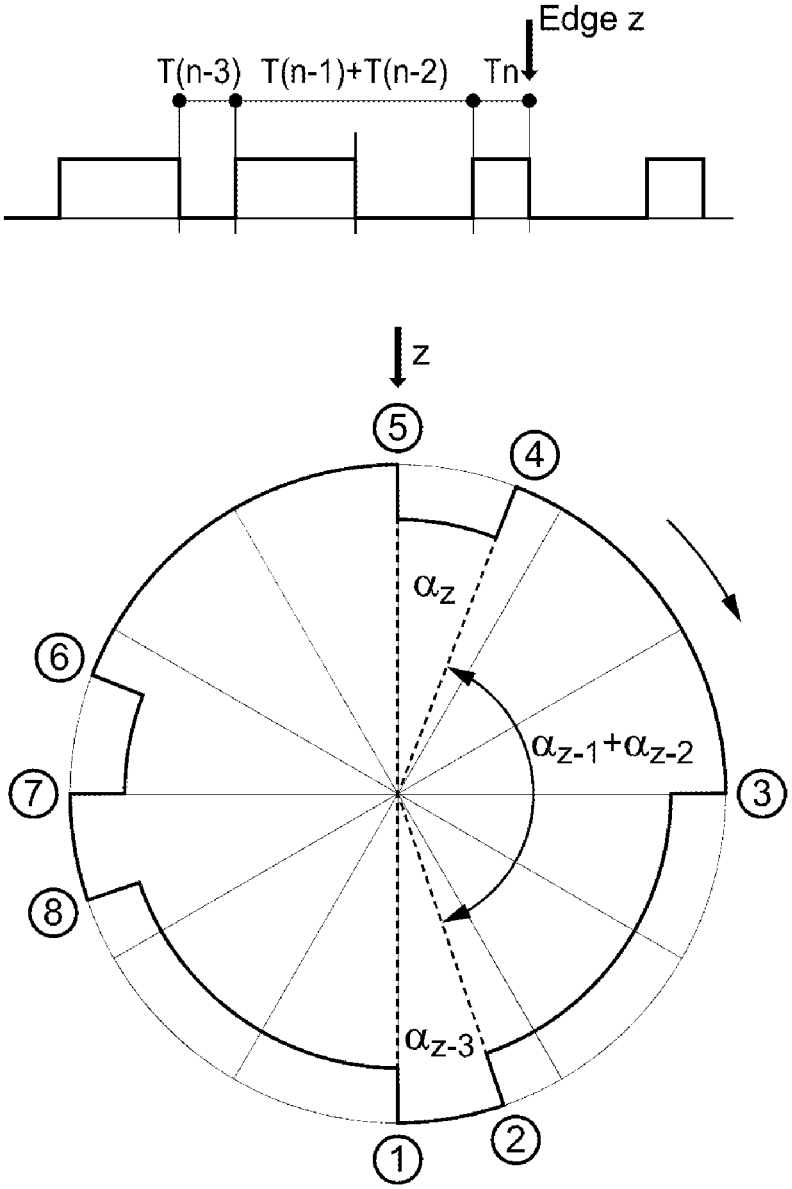
FIG. 2*c* shows an example of a camshaft target.

A target in the form of a toothed wheel 1 is mounted on the camshaft 91 or on each camshaft, an example of which target is shown in FIG. 2*c*. The target 1 comprises a set of teeth distributed over its periphery, with each tooth comprising a rising edge and a falling edge. The teeth of the target are advantageously uneven to allow the individual identification of each edge from among the set of edges of the target.

A sensor 2 for sensing the position of the camshaft (for example, of the Hall effect cell, magneto-resistive cell type, etc.) is positioned in front of the toothed wheel and is adapted for detecting each rising or falling edge of a tooth of the target.

With reference to FIG. 2*b*, the engine M also comprises an engine computer 95 comprising a processing unit 21 comprising, for example, a processor 22 or a microcontroller and a memory 23, the processing unit 21 being configured to implement, on the basis of the raw signals of rising or falling edges detected by the sensor 2, a synchronization method that will be described in further detail hereafter, and for which the code instructions for its execution are stored in the memory 23.

In order to implement the synchronization method, the processing unit 21 is advantageously configured to generate, based on the data from the detector, an external synchronization variable Vsyn, which can assume a value indicating a synchronization (Vsyn=Synok) and a second value indicating a synchronization fault (Vsyn=Wtsyn). The synchronization variable is set, during engine start up, to the value Wtsyn indicating a synchronization fault. An external variable is understood to be a variable intended to be transmitted by the processing unit to other components or functional blocks 950 of the engine computer 95 for implementing methods requiring knowledge of the position of the camshaft, for example, the injection of fuel, the ignition, the variable distribution, etc. On the contrary, an internal variable will be subsequently called a variable that is only used in an algorithm executed by the processing unit and that is not transmitted to the other blocks of the engine computer.

The processing unit 21 also generates another external variable Idft representing the edge of the target that has been identified as corresponding to the edge detected by the detector.

The engine computer 95 advantageously comprises other processing modules 950 adapted for receiving the angular position signals of the crankshaft 9, as well as the external variables generated by the processing unit 21, and to deduce therefrom a state of the engine cycle at each instant and to implement control methods, for example, injection and ignition of the fuel.

Synchronization Method

Figure 3A:
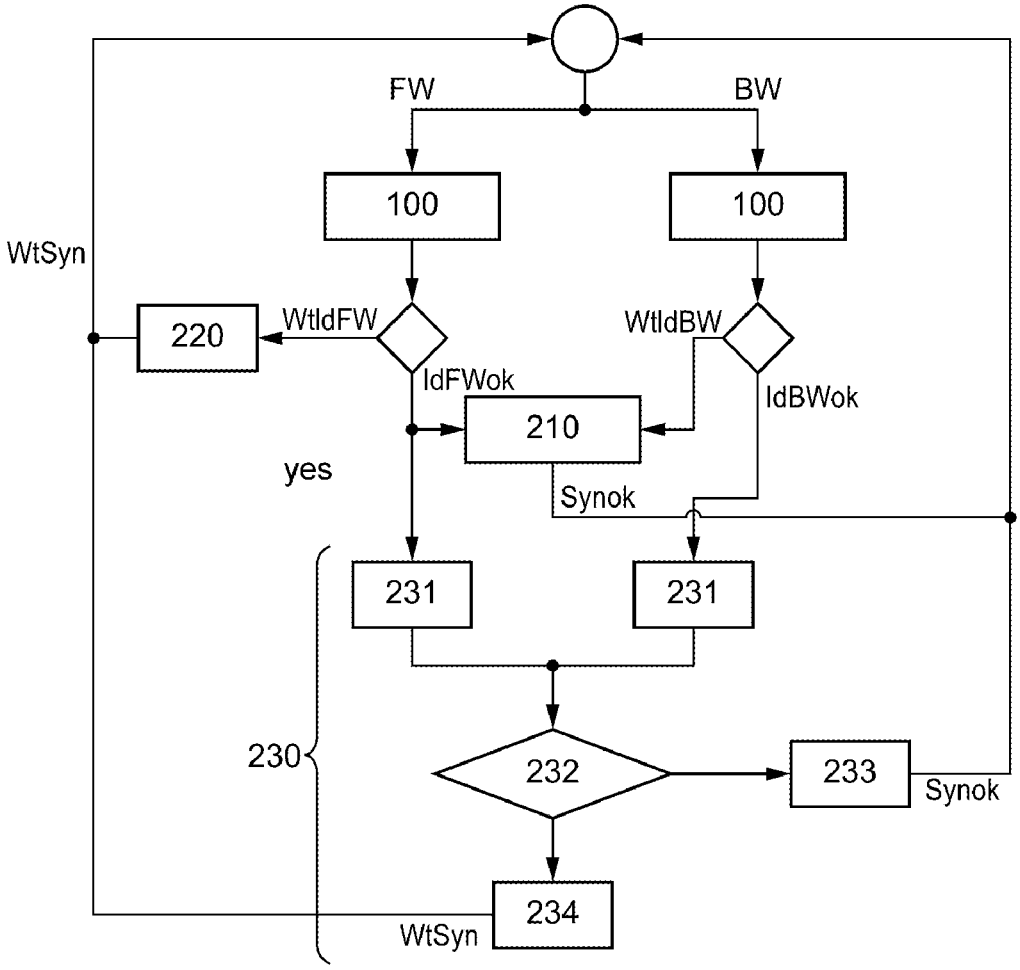
FIG. 3*a* schematically shows the main steps of the synchronization method according to one embodiment of the invention.
Figure 3B:
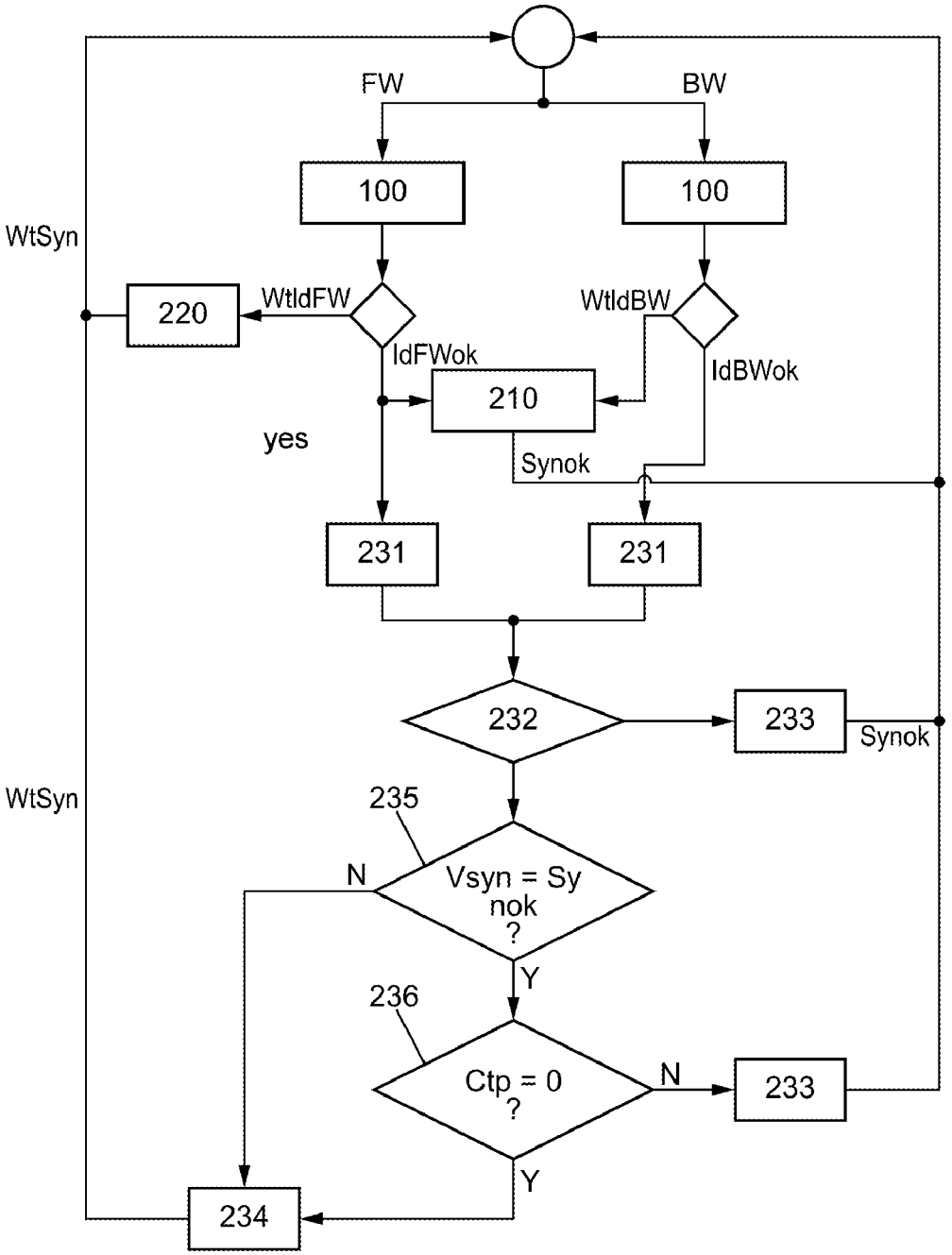
FIG. 3*b* schematically shows the main steps of the synchronization method according to another embodiment of the invention.
Figure 3C:
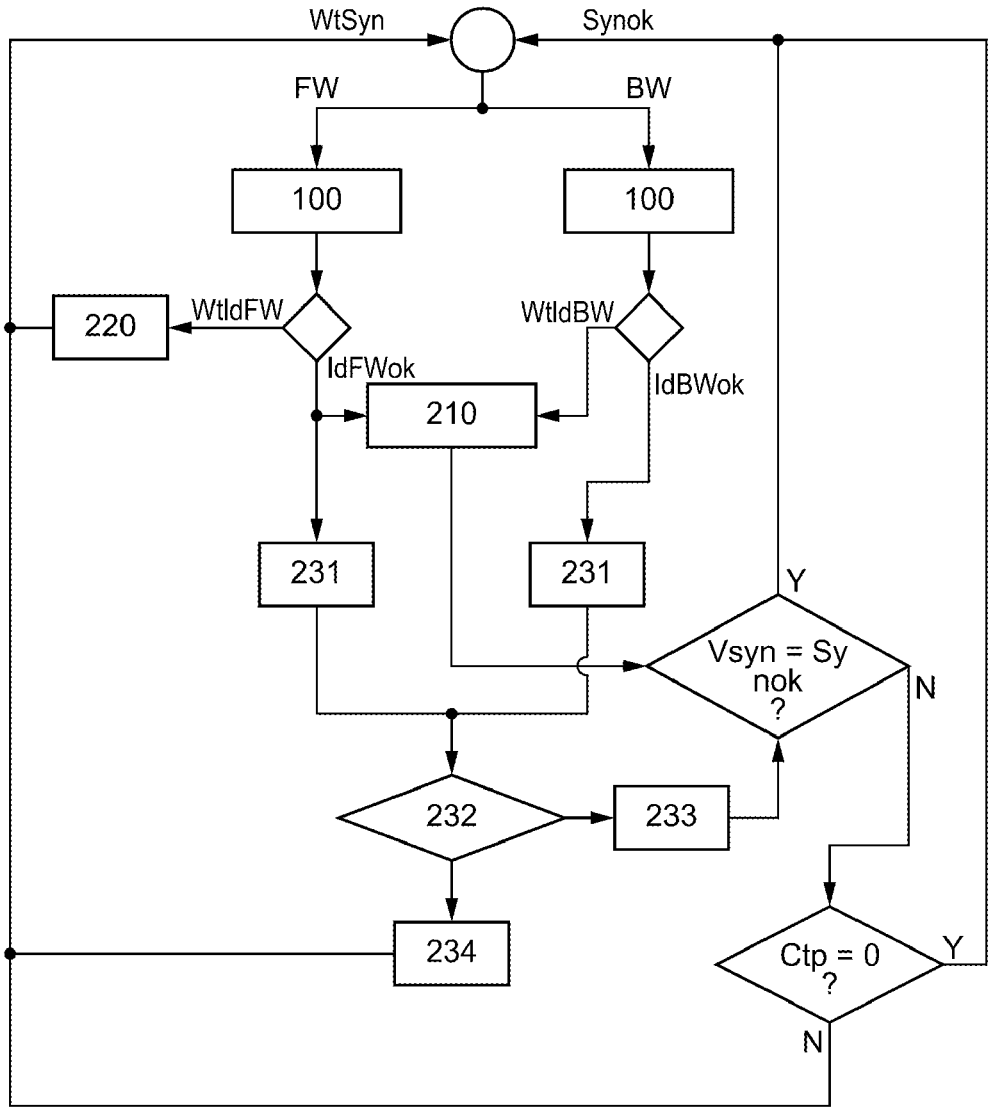
FIG. 3*c* schematically shows the implementation of the synchronization method according to another embodiment of the invention.

With reference to FIGS. 3, 4*a* and 4*b*, a synchronization method will now be described that is implemented by the processing unit of the position sensor for sensing the position of a camshaft. In FIGS. 3*a* to 3*c*, Y means yes and N means no.

The synchronization method comprises, upon receipt of a signal for detecting an edge by the detector, simultaneously implementing two methods 100 for identifying the detected edge, with one identification method being implemented considering a forward rotation of the target, and one identification method being implemented considering a reverse rotation of the target.

Identification Method

In order to implement each identification method 100, the processing unit 21 is advantageously configured to generate an internal identification variable, adapted for adopting a first value when the edge is identified, and a second value when, or as long as, the edge is not identified.

Since two identification methods 100 are conducted at the same time for two opposite directions of rotation of the target, the processing unit therefore generates two internal identification variables, respectively corresponding to each direction of rotation of the target. IdFW denotes the internal identification variable of an edge for a forward rotation of the target, and IdBW denotes the internal identification variable of an edge for a reverse rotation of the target.

When an edge is identified, the variables IdFW and IdBW respectively assume the value IdFWok and IdBWok, and when no edge is identified, the variables IdFW and IdBW respectively assume the value WtIdFW and WtIfBW.

With reference to FIG. 4*a*, the implementation of a method for identifying a detected edge, whether this is for a forward or rearward rotation, comprises a first step 110 of computing a time signature of the detected edge.

FIG. 2*c* shows an example of a camshaft target and at the top it shows the corresponding signal generated by the detector. The forward direction of rotation of the target is indicated by the arrow. The upper part of the figure shows the electrical signal produced by the detection of each edge of the target, the detection of a rising edge of the target corresponds to a falling edge of the electrical signal.

In one embodiment, the time signature of a detected edge is defined by:

$$\tau_R(n) = \frac{T_n}{T_{n-1}}$$

where n is the index of a detected edge and $T_n$ is the duration of the tooth (or of the hollow) preceding the edge n, i.e. the elapsed time between the detection of the edge n−1 and the detection of the edge n.

In this embodiment, the time signature can be computed from the third detected edge.

In an alternative embodiment, the time signature of a detected edge is defined by:

$$\tau_R(n) = \frac{T_n + T_{n-3}}{T_{n-1} + T_{n-2}}$$

In this embodiment, the time signature can only be computed from the fifth detected edge.

The selection between these two embodiments is set for a given engine and depends on the number of edges on the target and/or on the shape of the teeth. For example, the first method is preferably used if the target comprises a few teeth or if several teeth are identical. The second method is used for the other cases, since it is more effective in cases of acceleration and deceleration.

With further reference to FIG. 4*a*, during a step 120, the time signature of the detected edge is compared to a theoretical signature, precomputed and recorded in the memory, of at least one edge of the target of the same type as the detected edge and for the two possible directions of rotation of the target. Advantageously, during a first iteration of step 120, the time signature of the detected edge is compared to the theoretical signatures of all the edges of the target of the same type as the detected edge (in the two directions of rotation). As described in further detail hereafter, during the following iterations of step 120, this comparison can only occur for some of the edges of the target.

As previously indicated, the teeth of the target are advantageously uneven so that the theoretical signature of an edge can allow the edge to be identified. In this respect, the theoretical signature of an edge is not necessarily unique, but identification can be possible by adding the type of edge (rising or falling) and optionally by also adding a constraint on the sequence. For example, two theoretical signatures can be found with the same value but corresponding to two different types of edges, so that a single theoretical signature does not correspond to a detected edge.

According to another embodiment, there can be two theoretical signatures with the same value, but followed (for the following edge, for a considered direction of rotation) by two different theoretical signatures. It is then possible to identify the edge by elimination.

Furthermore, the target advantageously has rotational asymmetry allowing, on the basis of the comparison of a time signature of a detected edge with the theoretical signatures computed for the edges of the target, the direction of rotation of the target to be distinguished. To this end, the target is advantageously designed so that the main faces of the target do not have any axial symmetry. A non-limiting example of a target allowing edges to be identified is shown in FIG. 2*c*.

In this way, at least one of the following two conditions is followed for all the edges of the target:

- the theoretical signature computed for an edge considering a forward rotation of the target differs from the theoretical signature computed for the same edge considering a reverse rotation of the target; or
- if a theoretical signature for an edge is the same for the two directions of rotation of the target, then the one or more value(s) of the theoretical signature of the one or more following edge(s) is/are different between the two directions of rotation of the target.

Thus, the memory 23 stores, for each edge, a theoretical signature of the edge for a forward rotation of the target, and a theoretical signature of the edge for a reverse rotation of the target. The type of edge is also stored for the two directions of rotation. A rising edge in one direction of rotation becomes a falling edge for the reverse direction of rotation.

In a first embodiment, the theoretical signature is defined by:

$$\tau_{th}(n) = \frac{\alpha_n}{\alpha_{n-1}}$$

where $\alpha_n$ is the angle between the edge with the index n and the previous edge (some angles are shown in FIG. 2*c* considering an edge z). The edges preceding the considered edge are not the same depending on whether the target is considered to be in forward rotation or in reverse rotation, which explains the computation of one theoretical signature for each direction of rotation.

The theoretical signature of an edge of the target in reverse rotation also can be seen as the theoretical signature of the same edge of the reversed target (or seen in a mirror) in forward rotation.

This embodiment is retained if the time signature of an edge is computed according to the first equation indicated above:

$$\tau_R(n) = \frac{T_n}{T_{n-1}}$$

As an alternative embodiment, the theoretical signature of an edge is computed using the following equation:

$$\tau_{th}(n) = \frac{\alpha_n + \alpha_{n-3}}{\alpha_{n-1} + \alpha_{n-2}}$$

This alternative embodiment is implemented in the event that the time signature is only computed from the fifth detected edge as follows:

$$\tau_R(n) = \frac{T_n + T_{n-3}}{T_{n-1} + T_{n-2}}$$

Advantageously, in order to compare the time signature of the detected edge with the theoretical signatures of the edges of the target, a tolerance range is provided for each theoretical signature.

This tolerance range is defined, for each theoretical signature of an edge $\tau_{th}(n)$ by:

$$\left[\frac{\tau_{th}(n)}{k}, \tau_{th}(n) \cdot k\right],$$

where k is a tolerance factor that is strictly greater than 1, advantageously ranging between 2 and 3, for example, ranging between 2 and 2.5.

The comparison of the time signature of the detected edge with a theoretical signature of an edge is performed by determining whether the time signature of the detected edge is included in the tolerance range.

If, on completion of step 120, the detected edge does not correspond to any theoretical signature of an edge of the target of the same type, i.e. the time signature of the detected edge is not included in any tolerance range of the theoretical signatures of the edges of the target of the same rising or falling type, the method stops at a step 130 where the detected edge has not been identified, and the internal identification variable assumes the second value WtIdFW/WtIdBW.

If, on completion of step 120, the detected edge corresponds to a single edge of the target, of the same type (i.e. the time signature of the detected edge is included in the tolerance range of the theoretical signature of an edge of the same type), the identification method stops at a step 140 where the detected edge is identified as that for which the theoretical signature corresponds to the time signature of the edge, and the internal identification variable corresponds to the first value IdFWok/IdBWok.

Finally, if, on completion of step 120, the detected edge corresponds to a plurality of candidate edges of the target, i.e. the time signature of the detected edge is included in the tolerance range of a plurality of theoretical signatures of edges, the internal identification variable assumes the second value 150 WtIdFW/WtIdBW and steps 110 and 120 are implemented again for the following edge, by only using, for the comparison of step 120, the edges that immediately follow the candidate edges (these edges depend on the direction of rotation of the target). Steps 110 and 120 can be repeated until a unique correspondence 140 has occurred, or until no correspondence 130 has occurred, in which case steps 110 and 120 are again implemented normally from the following edge.

Of course, the identification method is implemented for each detected edge, therefore each step 130, 140 150 is followed by the reiteration of the method 100 for the next detected edge.

Advantageously, but optionally, the next iteration of the method 100 depends on the result of the preceding iteration.

Thus, advantageously on completion of step 140, where a single edge has been identified, during the next iteration of the method 100 the time signature of the next detected edge is only compared with a single theoretical signature, which is that of the edge that follows that which has been previously identified. In the event of no correspondence, the synchronization is lost and the internal identification variable assumes the second value WtIdFW/WtIdBW.

On completion of step 130, where no edge has been identified, during the next iteration of the method 100 it is possible to wait for the detection of three or five edges, respectively, depending on the mode for computing time and theoretical signatures, so as not to retain the preceding detection times for which no edge has been identified.

With further reference to FIGS. 3*a* to 3*c*, the remainder of the synchronization method depends on the result of the two identification methods 100 that are conducted at the same time.

If the identification of an edge has only occurred for a forward rotation of the target (internal variable in the IdFWok state), then the synchronization variable Vsyn generated by the processing unit assumes the synchronization value synok (step 210). Advantageously, the processing unit 21 also generates a signal indicating the edge identified as corresponding to the detected edge (transmission of the external variable ldft at a value identifying the detected edge).

If no edge identification has occurred for a forward rotation of the target (internal variable in the WtldFW state), then the synchronization variable generated by the processing unit assumes the synchronization fault (WtSyn—step 220). Indeed, in this case, even if an edge has been detected for a reverse direction of rotation of the target, the synchronization must not occur.

Finally, if an edge identification occurred for a forward rotation (IdFWok) and for a reverse rotation (IdBWok) of the target, then the method comprises an additional step 230 of determining a direction of rotation of the target.

To this end, during a step 231, a difference is determined between the time signature of the detected edge and the theoretical signature of the corresponding edge, for the edges identified for the two directions of rotation of the target.

The difference is advantageously computed as the ratio between the time signature and the theoretical signature of the edge.

Then, during a step 232, a comparison is implemented between the absolute values of the logarithms of the two differences in order to determine the direction of rotation of the target. The target is considered to be in reverse rotation if the difference between the time signature of the edge and the theoretical signature of the corresponding edge for the reverse rotation is less than the same difference for the forward rotation, with a margin. Advantageously, determining the reverse rotation occurs when the following relation is verified:

$$\left|\log_{10}\left(\frac{\tau_R(n)}{\tau_{thFW}(Id_{FW})}\right)\right| - \left|\log_{10}\left(\frac{\tau_R(n)}{\tau_{thBW}(Id_{BW})}\right)\right| \geq m$$

where $Id_{FW}$ is the edge identified when implementing the method 100 in the forward direction of rotation, $Id_{BW}$ is the edge identified when implementing the method 100 for the reverse direction of rotation, $\tau_{thFW}$ and $\tau_{thBW}$ are the respective theoretical signatures of the edges identified in the forward and reverse direction, and m is a tolerance margin.

If the direction of rotation is determined as being the forward direction 233, the synchronization variable assumes the synchronization value (Synok) and the processing unit also generates a signal indicating the edge identified in the forward direction of rotation as being the detected edge.

If the direction of rotation is determined as being the rearward direction 234, the synchronization variable assumes the synchronization fault value WtSyn.

In one embodiment, which is schematically shown in FIG. 3*b*, a counter is implemented, the purpose of which is to detect a successive number of comparisons promoting the reverse rotation before losing synchronization. The counter is denoted cpt and is set to a value N.

In this case, if the synchronization variable previously had the synchronization value Synok (235), then for each successive detected edge where the direction of rotation is determined as the rearward direction on completion of step 232, the synchronization variable keeps the synchronization value Synok and the counter is decremented, and the synchronization variable assumes the synchronization fault value WtSyn (i.e. that a loss of synchronization has occurred) only when the counter reaches a zero value.

In this case, as long as the counter has not reached a zero value (step 236), each time the direction of rotation is determined as being the reverse direction, the counter is decremented, the external synchronization variable keeps the synchronization value Synok, and the processing unit generates a signal (Idft) indicating the edge identified in the forward direction of rotation as being the edge detected according to a step similar to the step 233 described above.

This ensures that the synchronization is not immediately lost at the risk of having some measurement errors. Advantageously, the initial value of the counter ranges between 1 and 5. The fact that it is below 5 allows the measurement errors to be limited before the loss of synchronization.

The counter cpt is reset to its initial value as soon the synchronization method results in one of the cases 220, 210 or 234 described above.

As an alternative embodiment, the counter cpt can be set to 0 and can be incremented each time the direction of rotation is determined as being the reverse direction, until the maximum value N is reached that causes the loss of synchronization or until it is reset.

In another embodiment, which is schematically shown in FIG. 3*c*, if the synchronization has been lost, i.e. the synchronization variable has transitioned from the synchronization value Synok to the desynchronization value WtSyn, for example, during cases 234 or 220 described above, the synchronization is only recovered if a sufficient number of consecutive detected edges corresponds to a forward rotation of the target.

To this end, a counter cpt' is implemented, for example, at an initial value N' that is greater than or equal to 1, preferably strictly greater than 1, for example, equal to the number of edges of the target.

Then, during the implementation of the synchronization method for each detected edge, when the detected edge is identified as being an edge of the target in a forward direction of rotation (case 210, 233) and the external synchronization variable Vsyn has the synchronization fault value WtSyn, the external synchronization variable Vsyn keeps the synchronization fault value WtSyn and the counter is decremented until its value is zero. When the counter cpt' reaches a zero value, then for the next consecutive detected edge corresponding to a forward rotation of the target, the synchronization variable VSyn then assumes the synchronization value Synok.

This counter is used to validate that the engine has effectively returned to forward rotation, before confirming the synchronization.

As an alternative embodiment, the counter cpt' can be set to 0 and be incremented each time the detected edge is identified as an edge of the target in a forward direction of rotation, until it reaches the maximum value N' that leads to, through the synchronization variable, the synchronization value being assumed or reset if a rearward direction of rotation is detected or once the synchronization is recovered (transition from the value WtSyn to the value Synok).

In one embodiment, the synchronization method is also made effective against an engine stalling phase.

An engine stalling phase generally occurs shortly before the engine stops, and therefore generally during a reduction in the engine speed.

Consequently, when the synchronization method described above is implemented, if the engine speed drops below a predetermined threshold, the comparison of the time signature of an edge detected with the theoretical signatures of all the edges of the target, in the forward and reverse direction, is advantageously implemented with a reduced tolerance range compared to the tolerance range described above in the standard case.

This makes it harder to identify an edge and therefore lose the synchronization instead of incorrectly identifying an edge.

To this end, advantageously in the memory of the processing unit, each edge, considered in a direction of rotation of the target, is associated with a tolerance range, called standard range, and a tolerance range, called reduced range, with either one being selected as a function of the development of the engine speed.

For the reduced tolerance range, the tolerance factor k' is strictly less than the tolerance factor k introduced above. For example, the tolerance factor k' is advantageously 30 to 50% less than the tolerance factor k of the standard tolerance range.

The engine speed threshold, below which the tolerance range is reduced, is less than the idling speed for the considered engine. Advantageously, it is less than or equal to 600 revolutions per minute.

Advantageously, a timer is also triggered during the transition from the standard tolerance to the reduced tolerance, so that the tolerance remains reduced until the timer has elapsed and the engine speed has returned above the threshold engine speed, or until a loss of synchronization has effectively occurred, where the tolerance then reverts to its standard value.

This timer allows a reduced tolerance state to be maintained throughout the entire stalling period to avoid incorrect synchronization during this period.

With reference to FIG. 4*b*, when the engine comprises an intake camshaft and an exhaust camshaft, each comprising a target and a respective position sensor, at least one of the two targets has rotational asymmetry, and advantageously the two targets are asymmetrical.

In this case, the engine computer 95 comprises a processing unit 21 specific to each sensor, i.e. adapted for processing the signals for detecting the edges of each sensor.

If the two targets are asymmetrical, the processing units 21 corresponding to the two sensors are adapted to implement the synchronization method according to the previous description. This is the case that is schematically shown in FIG. 4*b*.

If only one target is asymmetrical, the corresponding processing unit 21 is adapted to implement this synchronization method, whereas the other processing unit is adapted to implement a synchronization method only by finding a correspondence between a detected edge and one of the edges of the target considered to be rotating forward (if the target is symmetrical, the theoretical signature of an edge is the same irrespective of the direction of rotation).

In all cases, if a reverse rotation is detected when implementing the synchronization method using at least one of the processing units 21 in a step 250, then the two processing units 21 are configured so that the synchronization variable generated by each processing unit assumes the synchronization fault value (260), even if the other processing unit has identified a target edge in a forward direction of rotation of the target. Indices 1 and 2 have been added to the values of the synchronization variable corresponding to the processing units of the two camshafts.

The invention claimed is:

1. A method for synchronizing an internal combustion engine comprising:

at least one camshaft (91), on which a target (1) is mounted in the form of a toothed wheel, each tooth comprising a rising edge and a falling edge, the wheel having rotational asymmetry;

a position sensor (2) for sensing the position of the camshaft, adapted to detect each rising or falling edge of a tooth of the target; and a unit (21) for processing data generated by the sensor (2), comprising a memory (23), in which, for each edge of each tooth of the target, a theoretical signature of the edge is stored considering a forward rotation of the target, and a theoretical signature of the edge is stored considering a reverse rotation of the target, each theoretical signature being associated with a range of tolerance values;

the synchronization method being implemented by the processing unit (21) and comprising the implementation of the following steps:

for each detected tooth edge:

implementing a method (100) for identifying the detected edge considering a forward rotation of the target;

implementing a method (100) for identifying the detected edge considering a reverse rotation of the target;

the implementation of a method (100) for identifying an edge detected for a direction of rotation comprising:

computing (110) a time signature of the detected edge; and comparing (120) the time signature of the detected edge with the ranges of tolerance values of a set of theoretical signatures of edges of the target of the same rising or falling type as the detected edge, corresponding to the direction of rotation of the target;

determining a direction of rotation of the target (232); and transmitting a synchronization or synchronization fault signal as a function of the direction of rotation of the determined target.

2. The synchronization method as claimed in claim 1, wherein, if the detected edge is determined to be corresponding to an edge of the target in forward rotation, and to be corresponding to an edge of the target in reverse rotation, and if the time signature of the detected edge is within the range of tolerance values of a theoretical signature of a single edge (140), the detected edge is identified as the edge corresponding to the theoretical signature, and if the time signature of the detected edge is within the range of tolerance values of a theoretical signature of more than one candidate edge (150), the steps of computing a time signature (110) and of comparing (120) the time signature with the following edge are repeated, the comparison (120) only being implemented with the theoretical signatures of the edges following the candidate edges.

3. The synchronization method as claimed in claim 2, wherein the time signature of a detected edge is defined, for each edge detected from the third, by:

$$\tau_R(n) = \frac{T_n}{T_{n-1}}$$

where n is the index of a detected edge and $T_n$ is the duration between the index edge n−1 and the index edge n; and the theoretical signature of an edge with which the time signature of a detected edge is compared is defined by:

$$\tau_{th}(n) = \frac{\alpha_n}{\alpha_{n-1}}.$$

4. The synchronization method as claimed in claim 2, wherein the time signature of a detected edge is defined by: for each edge detected from the fifth, by:

$$\tau_R(n) = \frac{T_n + T_{n-3}}{T_{n-1} + T_{n-2}}$$

where n is the index of a detected edge and $T_n$ is the duration between the index edge n−1 and the index edge n; and the theoretical signature of an edge with which the time signature of a detected edge is compared is defined by:

$$\tau_{th}(n) = \frac{\alpha_n + \alpha_{n-3}}{\alpha_{n-1} + \alpha_{n-2}}$$

where $\alpha_n$ is the angle between the index edge n and the preceding edge, which depends on the direction of rotation of the target.

5. The synchronization method as claimed in claim 1, wherein the range of tolerance values associated with each theoretical signature of the set of theoretical signatures of the edges of the target is reduced when the engine speed drops below a predetermined threshold.

6. The synchronization method as claimed in claim 1, comprising, if, during the implementation of the method (100) for identifying the detected edge considering a forward rotation of the target, no correspondence is detected, transmitting (220) a synchronization fault signal (Wtsyn).

7. The synchronization method as claimed in claim 1, comprising, if the detected edge is determined to be corresponding to an edge of the target considering a forward rotation, and does not correspond to any edge of the target considering a reverse rotation (210), transmitting a synchronization signal (Synok).

8. The synchronization method as claimed in claim 2, wherein the assessment (232) of a direction of rotation of the target is implemented by a comparison between:

a first logarithm of the ratio between the time signature of the detected edge and the theoretical signature of the corresponding edge for the forward direction of rotation of the target; and a second logarithm of the ratio between the time signature of the detected edge and the theoretical signature of the corresponding edge for the rearward direction of rotation of the target.

9. The synchronization method as claimed in claim 8, wherein the direction of rotation is determined as being the rearward direction of rotation if a difference between the first and the second logarithm is greater than a predetermined margin value.

10. The synchronization method as claimed in claim 1, comprising:

transmitting a synchronization signal if the direction of rotation of the target is a forward rotation; and transmitting a synchronization fault signal if the direction of rotation of the target is a reverse rotation.

11. The synchronization method as claimed in claim 1, wherein the transmission of a synchronization or synchronization fault signal is also performed as a function of a previous synchronization or synchronization fault signal transmitted by the processing unit.

12. The synchronization method as claimed in claim 11, wherein the processing unit is adapted to generate an external synchronization variable (Vsyn) that can assume a first value (Synok) forming the synchronization signal, and a second value (WtSyn) forming the synchronization fault signal, and wherein, if the external synchronization variable (Vsyn) assumes the first value (Synok) when the direction of rotation of the target is determined as being rearward (234), a counter (cpt) is decremented and the external synchronization variable (Vsyn) only assumes the second value (WtSyn) if the counter reaches a zero value.

13. The synchronization method as claimed in claim 11, wherein, in the event of a loss of synchronization, the processing unit is adapted to only transmit the next synchronization signal in the event of the detection of a predetermined number of successive edges determined to be corresponding to a forward rotation of the target.

14. The synchronization method as claimed in claim 1, implemented by an engine (M) comprising:

an intake camshaft (91) and an exhaust camshaft (11), with a target (1) being respectively mounted on each shaft, at least one of which has rotational asymmetry; and two position sensors (2) respectively for sensing the position of each camshaft (91); and two processing units (21), each processing unit (21) being adapted to process the data generated by a respective position sensor (2), the processing units (21) being adapted to generate an external synchronization variable (Vsyn) that can assume a first value indicating a synchronization (Synok) and a second value indicating a synchronization fault (Wtsyn);

wherein, if a processing unit (21) corresponding to an asymmetrical target generates a synchronization fault signal (WtSyn1) on completion of a step of determining a direction of rotation of the camshaft, the other processing unit is configured to generate a synchronization fault signal (WtSyn2) for the camshaft with which it corresponds.

15. A non-transitory computer-readable medium on which is stored a computer program, comprising code instructions for implementing the synchronization method as claimed in claim 1 when implemented by a computer (22) adapted to implement the method.

16. An internal combustion engine (M) comprising:

at least one camshaft (91), on which a target (1) is mounted in the form of a wheel comprising a plurality of teeth distributed over the wheel's circumference, each tooth comprising a rising edge and a falling edge, the wheel having rotational asymmetry;

a position sensor (2) for sensing the position of the camshaft, adapted to detect each rising or falling edge of a tooth of the target; and a processing unit (21) receiving signals for detecting the edge of the sensor, and configured to implement the synchronization method as claimed in claim 1.

17. The synchronization method as claimed in claim 2, wherein the range of tolerance values associated with each theoretical signature of the set of theoretical signatures of the edges of the target is reduced when the engine speed drops below a predetermined threshold.

18. The synchronization method as claimed in claim 3, wherein the range of tolerance values associated with each theoretical signature of the set of theoretical signatures of the edges of the target is reduced when the engine speed drops below a predetermined threshold.

19. The synchronization method as claimed in claim 4, wherein the range of tolerance values associated with each theoretical signature of the set of theoretical signatures of the edges of the target is reduced when the engine speed drops below a predetermined threshold.

20. The synchronization method as claimed in claim 2, comprising, if, during the implementation of the method (100) for identifying the detected edge considering a forward rotation of the target, no correspondence is detected, transmitting (220) a synchronization fault signal (Wtsyn).

* * * * *